United States Patent [19]

Bradford et al.

[11] 4,241,953

[45] Dec. 30, 1980

[54] SULFUR MINE BLEEDWATER REUSE SYSTEM

[75] Inventors: Randol W. Bradford, Waggaman; Michael H. Carmichael, Pearl River, both of La.

[73] Assignee: Freeport Minerals Company, New York, N.Y.

[21] Appl. No.: 32,483

[22] Filed: Apr. 23, 1979

[51] Int. Cl.[3] ..... E21B 43/28

[52] U.S. Cl. ..... 299/4; 299/6

[58] Field of Search ..... 299/4, 6

[56] References Cited

U.S. PATENT DOCUMENTS

| | | | |
|---|---|---|---|
| 1,615,050 | 1/1927 | Stewart | 299/6 |
| 1,764,538 | 6/1930 | Stewart | 299/4 |
| 2,137,619 | 11/1938 | Lee | 299/6 |
| 2,896,932 | 7/1959 | Marquis | 299/4 X |

*Primary Examiner*—Ernest R. Purser

*Attorney, Agent, or Firm*—Fisher, Christen & Sabol

[57] ABSTRACT

A novel system is disclosed for utilizing, in the mining of subterranean sulfur by the Frasch process, the heat of water that has accumulated underground above at least a portion of the subterranean sulfur deposit from previous mining operations wherein the underground water is brought to the surface, mixed with fresh heated water, and returned underground to melt the subterranean sulfur via a return pipeline which is separate and distinct from the pipeline through which the molten sulfur is brought to the surface. In one embodiment the return pipeline is in the same well casing as the sulfur pipeline, but displaced laterally from it. In a second embodiment, the return pipeline extends through a separate well casing.

17 Claims, 6 Drawing Figures

20
16
15
14
23
13
5
12
CAPROCK
14
4
10
21
22
10
BARREN
LIMESTONE
19
19
SULFUR
BEARING
FORMATION
15
17
11
18
18
ANHYDRITE
2
1
SALT

AIR
HOT WATER MIXTURE
SULFUR
38
58
13
42
CAPROCK
52
BARREN
LIMESTONE
50
10
44
10
54
SULFUR
BEARING
FORMATION
46
56
52a
48
ANHYDRITE
50a
SALT

SULFUR MINE BLEEDWATER REUSE SYSTEM

BACKGROUND OF THE INVENTION

1. Field of the Invention

This invention relates to the mining of subterranean solid sulfur by the Frasch method in which hot water is sent below the surface to liquefy the sulfur and the sulfur in liquid form is brought to the surface. In such a process, the hot water accumulates above at least a part of the subterranean solid sulfur. This invention more specifically relates to the conservation and utilization of the heat energy contained in the accumulated subterranean hot water.

2. Brief Description of the Prior Art

Sulfur occurs in the caprock of certain salt domes along the coastal area of the Gulf of Mexico and in the offshore waters of the Gulf. The salt domes are believed to have been formed by the intrusion of salt from extremely deep lying beds of salt into the sedimentary formation of this region. The salt intrusions are circular or elliptical in cross section and the tops of the domes vary in depth below mean sea level, usually from less than one hundred feet to several thousand feet. Occasionally, the tops rise to the surface. The tops of some salt domes are capped with limestone, anhydrite, gypsum, or a combination of these minerals. A cross section of a typical salt dome is shown in FIG. 1.

In the caprock of some of the domes of this type containing limestone with other minerals present, sulfur is found in fissures, cracks, seams and dispersed through the formation. Sulfur is also occasionally present to a lesser extent in the gypsum and anhydrite associated with the limestone of the dome. Most salt domes which are below the surface of the area in which they lie are covered with a layer of shale or other sediments which in essence forms the caprock into a closed container. The sulfur formation is often sandwiched between a layer of overlying barren limestone and an underlying layer of anhydrite. Underneath the anhydrite is the salt proper. Fewer than 10% of the salt domes discovered so far in the coastal region of the Gulf of Mexico have contained sulfur that is economically minable in commercial quantities.

After a dome has been discovered and has been proven to possess economically minable commercial quantities of sulfur in the caprock, the Frasch system of mining is usually initiated. In a typical system, a hole is drilled to a selected zone in the sulfur-bearing limestone by means of oil field type drilling equipment. The well, after drilling, usually is equipped with three concentric pipes within a protective casing which is cemented into the top of the caprock. Inside the outer casing a six-inch pipe is sunk through the caprock to the bottom of the sulfur deposit. The six-inch pipe is perforated with small holes in its lower end portion. Then a three-inch pipe is lowered to a point spaced a short distance from the bottom. Last, and innermost, is a one-inch pipe carrying compressed air and reaching more than half way to the bottom of the well.

Water, heated under pressure to about 325° F. (well above the normal 212° boiling point) is pumped down the space between the six-inch and three-inch pipes, and, during the initial heating period described above, also down the three-inch pipe. The initial heating period can extend for periods of 24 to 96 hours and water is injected during this period at the rate of 250 to 750 gallons per minute. The "superheated" water flows out of the holes at the bottom of the six-inch pipe into the sulfur bearing deposit and moves upwardly because of the lower density of the hot water compared to the colder connate water. As the temperature of the sulfur bearing formation reaches and exceeds the melting point of the sulfur, liquid sulfur flows to the bottom of the well, as it is approximately twice as heavy as water. The pumping of water down the three-inch pipe is then discontinued. Static pressure of the hot water forced into the formation, plus pressure imposed within the dome, then forces liquid sulfur several hundred feet up the three-inch pipe. Compressed air forced down the small pipe aerates and lightens the liquid sulfur in the three-inch pipe so that it will rise the rest of the way to the surface. A single well can take the sulfur from only about a half acre of dome area. So new wells must be drilled continually, and new pipelines laid to bring in water and air and carry off the molten sulfur. Other pipe sizes may be used, but this in no way changes the general theory of Frasch mining. Mining systems of the Frasch type are disclosed in U.S. Pat. Nos. 1,612,453 and 928,036.

Since the caprock of the salt dome is essentially a closed container, the injection of hot water from mining purposes will build up the pressure in the dome unless it is relieved. Relief is accomplished by drilling "bleed-wells" to the floor of the dome and removing cold water. Cold water—as cold as practical—is removed to conserve heat in the dome and to maintain the desired mine pressure. In the course of time, large quantities of hot water accumulate in the upper regions of the dome in the barren areas and the leached areas (i.e., areas from which substantially all of the sulfur has been removed). The injection of millions of gallons of hot water (325° F.) into the hydraulically closed domes, with the removal of cold water for pressure control, has resulted in the accumulation of very large quantities, e.g., up to trillions of BTU's, of heat within the domes. The fluid densities within the caprock are such that the hot water rises as it exits the well bottom, and percolates upwardly through the sulfur-rich limestone. Although the water is cooling as it gives up its heat to the melting sulfur and the surrounding formation, it is still very hot when it enters the formations above the sulfur ore. In fact, temperatures in the range of 220° F. to 290° F. are frequently measured in this spent water near the top of the caprock. From this description, it can be seen that, in a typical Frasch process mine, a large limestone caprock exists with the lower portions containing elemental sulfur enrichment within the limestone matrix and with the upper portions containing a vast induced geothermal resource of hot water accumulated from past and ongoing mining operations. A large group of wells can be drilled into the lower portion of the caprock with virgin hot water being injected to continue the sulfur melting process.

Water, returned to the earth's surface (hereinafter designated as bleedwater), is still at an elevated temperature, and in addition to the usual constituents of ground waters such as chlorides, sulfates and bicarbonates of sodium, calcium and magnesium, contains hydrogen sulfide, thiosulfates, hydrosulfides and polysulfides, and other sulfur compounds of various basic elements (which will be designated hereinafter simply as sulfides) and various other dissolved substances. The sulfides and the other constituents in the bleedwater render it highly corrosive and extremely destructive to the usual materials encountered in the commercial operation of a sulfur mine by the Frasch process.

The re-use of the hot bleedwater would require all conduits and equipment with which it came into contact to be made of special noncorrosive materials, which are extremely costly. Commercial recovery of the heat in bleedwater has been attempted using a closed type of heat exchanger in which the bleedwater flows over conduits carrying colder fresh water, the heat transfer being from the bleedwater through the conduit material and into the fresh water. Only a small part of the heat can be commercially recovered in this manner and the heat exchangers must be constructed of costly non-corrosive materials.

The fundamental problem in the re-use of hot bleedwater for mining is that not only the bleedwater reheating plant, but also the water distribution pipelines and production wells are subjected to severe corrosion and scaling. U.S. Pat. No. 2,109,611 illustrates one attempt to treat bleedwater to render it suitable for re-use. The corrosion and scaling are a particularly important problem in the Frasch process production wells since, in certain modes of operation, the concentric well pipelines would be contacted on both sides by the bleedwater. While corroded distribution pipelines on the surface are relatively easy to replace, corroded well pipelines could very easily render the entire well inoperable. U.S. Pat. No. 1,764,538 illustrates one attempt at bleedwater re-use in a standard sulfur mining well which would suffer from these difficulties.

It has, therefore, been customary to attempt to locate the bleedwells so as to return to the surface as cold a bleedwater as possible and to discharge this water to waste. This practice has accounted for great losses by the sulfur mining industry in the past because of the non-recovery of the heat from the bleedwater, by the inability to re-use the bleedwater and by loss of heat due to the flow of the hot mine water to the upper formations of the deposit where it is no longer available for melting sulfur in situ. The disposal of the bleedwater thus produced is subject to the further disadvantage that the suspended and dissolved matter, hydrogen sulfide and metal sulfides contaminate the surface water into which the bleedwater may be permitted to flow. In order to prevent objectionable pollution, then, it is necessary to purify the bleedwater before its discharge. The apparatus and process of purification before disposal impose a heavy expense upon the sulfur mining industry.

The re-use of bleedwater brought to the surface could provide tremendous economic and environmental benefits. Several efforts have been made in this direction. Excessive scaling and corrosion, however, have caused many of these operations to be uneconomical.

One of the more successful of these prior art attempts to utilize the bleedwater heat is set forth in U.S. patent application Ser. No. 819,879 now U.S. Pat. No. 4,157,847 to R. L. Williams et al. entitled "Method and Apparatus for Utilizing Accumulated Underground Water in the Mining of Subterranean Sulphur" filed on July 28, 1977 and assigned to the assignee of this application. The method and apparatus described in the Williams et al. application differs from the present system insofar as it does not bring the hot bleedwater to the surface, mix it with fresh hot water, and return the mixture to the sulfur deposit via a separate downpipe. Rather, it uses a jet pump device to achieve a subterranean recirculation of the hot bleedwater.

In some instances in the past sulfur wells have been pumped with their liners bleeding water to the atmosphere, creating concurrent flows of sulfur and water. Heat is supplied to such wells by injecting hot mine water down through the caprock casing. The very aggressive nature of the bleedwater renders this technique highly corrosive to the liner and the sulfur delivery pipe. In addition, a considerable quantity of heat is lost to the atmosphere and the large amounts of bleedwater at the surface present serious pollution problems.

U.S. Pat. Nos. 3,525,550; 3,432,205; and 3,258,069 describe methods and apparatuses which seek to take advantage of natural hot geopressured aquifers disposed below subterranean sulfur deposits and depend upon special geological formations that may be rare or difficult and expensive to locate. U.S. Pat. No. 3,432,205 circulates hot water down one well and through the sulfur-bearing formation to a second well, upwardly through which moves a mixture of sulfur and hot water and produces large amounts of corrosive water which must be disposed of. U.S. Pat. No. 3,630,573 describes an attempt to reduce the amount of hot water injected into a sulfur well by separately injecting superheated steam and hot water. U.S. Pat. No. 1,339,621 discloses an air lift specially designed in the shape of a Venturi to give rising molten sulfur an extra lift. The methods and apparatus of these patents, however, do not utilize the recycling of hot water to conserve and use the large amount of heat in the subterranean accumulated hot water resulting from subterranean sulfur mining operations.

U.S. Pat. No. 3,938,592 describes a method for extracting heat from subterranean rock strata which have been fractured by one or more explosions and filled with stratal fluid to absorb heat from the rock strata. The heated stratal fluid is then recycled upwardly to heat a heat-carrying agent which is recycled through a heat exchanger to a surface plant where the heat values may be utilized. U.S. Pat. No. 3,333,638 refers to the disposal of water from a gas-producing zone to a lower water-absorbing zone. U.S. Pat. No. 3,515,213 refers to the recovery of shale oil by circulating hot water from the surface through the shale and back to the surface again using two wells. U.S. Pat. Nos. 2,742,091; 2,871,948; 2,980,184 and 3,322,195 all relate to various treatments of oil wells to rejuvenate them and obtain additional production. U.S. Pat. No. 2,742,091 discloses a method in which hot oil is recycled within the well or casing. None of these patents disclose or suggest the mining of sulfur wherein the subterranean hot water accumulations from previous mining operations are recycled through a separate downpipe to heat underlying sulfur for liquefying it.

SUMMARY OF THE INVENTION

The present invention provides a system for reclaiming the heat stored in sulfur-bearing domes which have been mined for years and which contain enormous quantities of hot water that have accumulated over the years mainly as a result of sulfur mining. The system of this invention is also of value in conserving and more fully utilizing hot mine waters in new mines (in which little or no hot water has accumulated). The system of this invention permits large fuel savings in the mining of underground sulfur as compared to the conventional Frasch hot process heretofore employed quite extensively throughout the sulfur mining industry. The invention also permits considerable reductions in the volume of new water and new heat needed for the sulfur mining operations and, as a consequence, also provides large reductions in the volume of bleedwater required to be removed, treated and/or disposed of. The present invention provides for significantly reduced subterranean sulfur mining costs and can permit the continued operation of heretofore marginal wells, mining areas and mines, ultimately permitting greater sulfur recovery.

It is a purpose of this invention to recover and re-use the heat of the hot underground water accumulated from ongoing and/or previous sulfur mining operations. The invention is especially applicable to the Frasch mining process wherein hot water having a temperature sufficiently high to liquefy sulfur is pumped underground to contact the subterranean sulfur-bearing ore to heat it and ultimately convert the solid sulfur contained by the ore to liquid sulfur which is then brought to the surface. In heating the sulfur-bearing ore, some of the heat of the hot water is spent and the water is somewhat reduced in temperature but remains hot and accumulates in large quantities underground. The spent hot water remains hot underground because of the insulating nature of the formation which surrounds it. Because of its lower specific gravity compared to liquid sulfur and cooler connate waters the spent hot water rises in the formation, e.g., in the leached or barren zones of the caprock, and accumulates in the upper regions thereof. The present invention comprises a system for recycling the accumulated hot water to the lower, sulfur-enriched, producing zones of the formation where it contacts and contributes heat to melt additional solid sulfur.

To achieve the purposes and objects of the invention hot, underground bleedwater is brought to the surface using standard well drilling techniques. The temperature of the bleedwater should be from 220° F. to 320° F. The hot bleedwater is mixed with virgin minewater which has been heated to a temperature of 325°-450° F. The mixture may be made up of from 20% to 95% bleedwater, and the temperature of the mixture should be greater than 260° F., preferably greater than 280° F. and most preferrably between 320°-330° F. On new wells just being started, the accumulated underground water, which may be mostly connate water, initially may have much lower temperatures than is required. Obviously, in that case, a lower percentage of bleedwater will be used in the mixture so as to not unduly lower the temperature of the mixture.

Sulfur melts in the range of about 235° F. to about 246° F. depending upon its solid form. The temperature of the hot water brought into contact with it must exceed the melting point of the solid sulfur being mined and, for a reasonably rapid melting rate, it should be exceeded by at least a few degrees. In general, the temperature of the water mixture brought into contact with the sulfur is in the range of about 260° F. to about 330° F. or higher if desired or practical, and preferably in the range of about 320° F. to about 330° F.

To minimize the deleterious effects of corrosion and scaling, a modified Frasch type well is used wherein the minewater-bleedwater mixture does not pass down to the sulfur through the usual concentric pipe arrangement, but through a separate pipeline. This separate pipeline is physically separate from the sulfur delivery pipeline, but may share the same well casing. The molten sulfur is made to come up to the surface through the sulfur delivery pipeline with a conventional air line inside. By using a separate hot water pipeline, the invention avoids the corrosive attack on both sides of the sulfur delivery pipe as in the conventional concentric pipe wells. Also, the separate pipeline is more readily replaceable once corrosion and scaling take place without disrupting the sulfur delivery and air pipelines.

To further minimize corrosion and scaling, the invention envisions the use of an inert material lined piping, or a stainless steel or titanium piping for the separate water mixture pipeline. A combination of an insert material lined mild steel and stainless steel or titanium piping may also be used to minimize the piping costs. Examples of inert materials for use as inert linings are cement and plastics such as Teflon and phenolic plastics. Galvanic corrosion at the juncture of the mild steel-stainless steel may be prevented by the use of dielectric pipe couplings, such as the type described in the U.S. patent application Ser. No. 8,112 "Dielectric Pipe Coupling for Use in High Temperature, Corrosive Environments" assigned to the assignee of this application and filed on Jan. 31, 1979. Of course, any other type of pipe coupling and other forms of piping may also be used without exceeding the scope of this invention. In addition to the lined piping, a corrosion inhibitor may be added to the bleedwater-minewater mixture. The inhibitor preferably takes the form of a quarternary amine such as those marketed under the tradenames Nalco Product No. 938, Visco 938 and Visco 1152.

The injection of millions of gallons of hot water (325° F.) over a period of many years into hydraulically closed domes being mined for sulfur, with only cold water removed for pressure control, results in the accumulation of very large quantities, e.g., up to trillions of BTU's, of heat within these formations. Previous attempts to reclaim this heat involved the domal water being brought to the surface, treated and re-injected into the standard Frasch type well. For many years, the return of this water to the surface for treatment, storage and reheating has been the subject of intense study. This corrosively aggressive fluid known as bleedwater has repeatedly proven to be an elusive resource for reclamation. Processes for the re-use of accumulated hot bleedwater from caprock have been tested and have generally proved to be uneconomical and impractical due to excessive scaling and corrosion characteristics of the bleedwater.

The present invention reduces the amount of new heat required to mine sulfur by the hot water process and is capable of improving the efficiency of existing installations.

The present invention provides for the introduction of "new" heat while recycling "old" heat to more productive zones in the caprock. It also reduces the impact to the environment by reducing the quantity of water bled from traditional Frasch process mining operations for disposal. In fact, as much as about 50% less water can be bled from a typical formation when the system of this invention is used than when conventional Frasch mining is carried out without the system of this invention. Even less water might be bled in some cases. This invention substantially reduces the well operating costs, thereby enabling a longer economical lifespan.

DETAILED DESCRIPTION OF THE PREFERRED EMBODIMENTS

Figure 1:
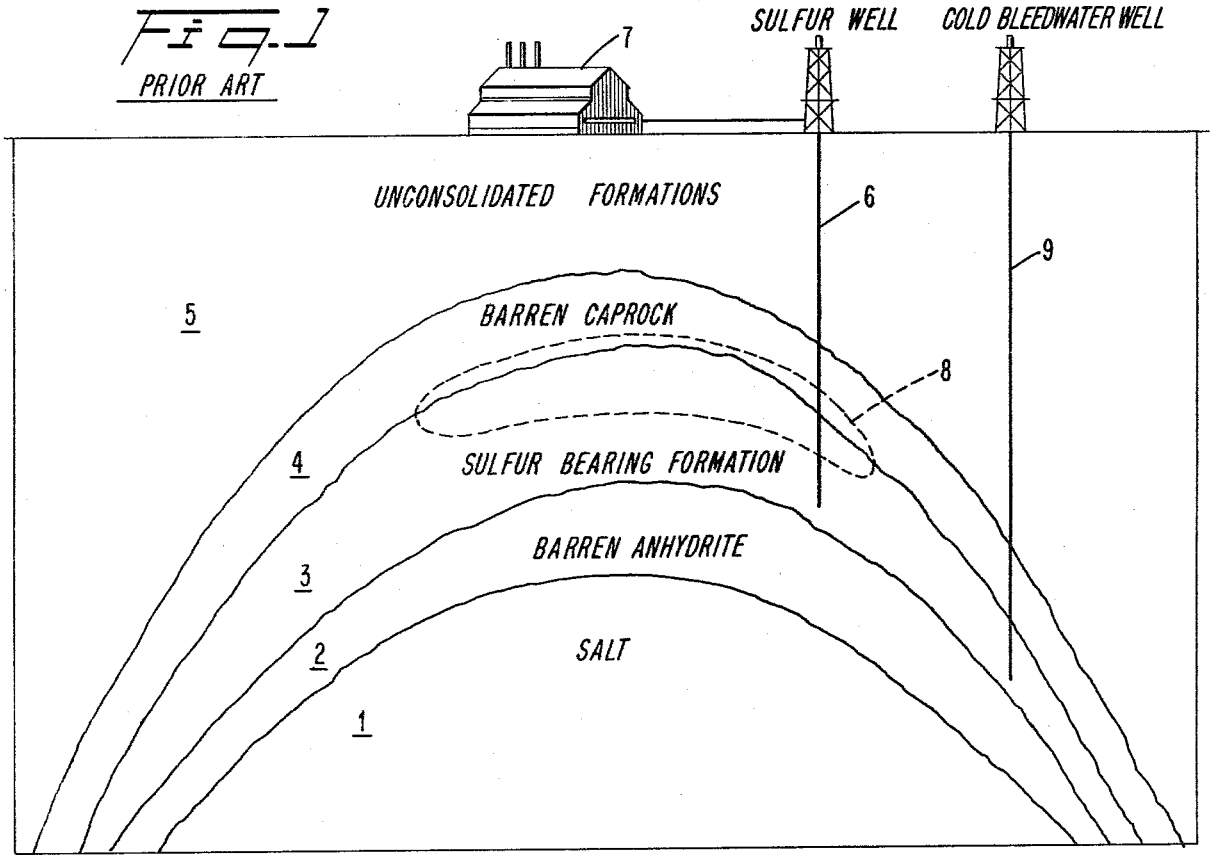
Fig. 1 PRIOR ART
FIG. 1 is a diagrammatic vertical sectional view of a salt dome formation containing sulfur-bearing ore illustrating a typical prior art system for mining sulfur by the Frasch process.

The salt dome formation previously described is illustrated in FIG. 1, wherein 1 indicates the salt, 2 the barren anhydrite, and 3 the sulfur bearing formation which usually comprises sulfur-bearing limestone. Number 4 indicates the barren caprock which contains little or no sulfur, while 5 indicates miscellaneous and unconsolidated formations.

A sulfur well 6, of the standard Frasch type, is supplied with hot water and compressed air by plant 7. Because of past sulfur mining operations, a zone or reservoir 8 of hot water has accumulated underground in the upper areas of the sulfur-bearing formation 3 from which areas most, if not all, of the sulfur has been removed by previous mining operations, and in the lower portions of caprock 4. This reservoir of hot accumulated underground water 8 usually has a temperature of between 200° F. and 320° F. and represents a considerable amount of stored heat. A cold bleedwater well 9 is provided for the purpose of regulating the pressure within the salt dome and to permit the continued operation of the sulfur well 6.

Figure 2:
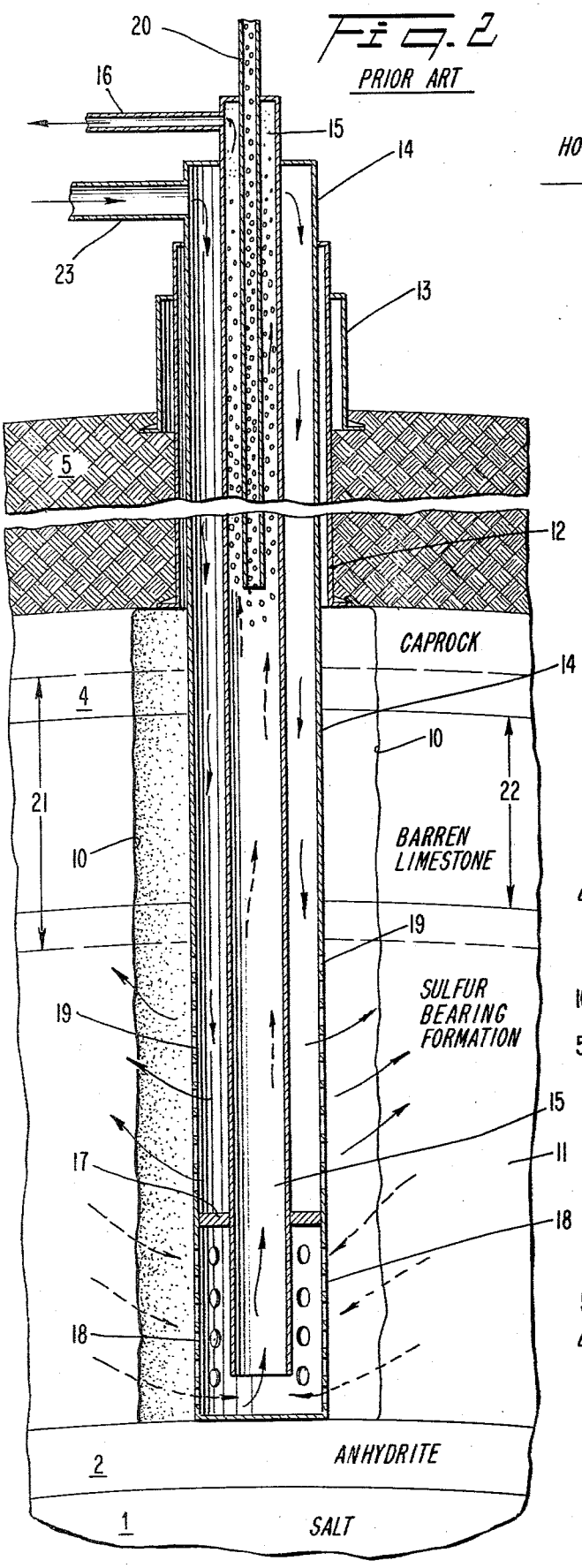
Fig. 2 PRIOR ART
FIG. 2 is a vertical, sectional view of a prior art sulfur well utilizing the Frasch process.

In FIG. 2, a prior art sulfur well using the standard Frasch process is shown. In a typical installation, drill hole 10 having a diameter of about 12.5 inches is sunk about 1640 feet to the bottom of the sulfur-bearing formation 11 and is provided with caprock casing 12 (about 8⅝ inch O.D. and about 1320 feet in length) and a surface casing 13 (about 10.75 inch O.D. and about 787 feet long). A liner 14 (about 1650 feet long and about 6⅝ inch O.D.) extends from the top to the bottom of the drill hole 10. The lower fifteen feet or so of the liner wall is perforated so as to permit the passage of fluid through the wall. Within the liner, there is provided a sulfur return pipe 15 (about 3.5 inch O.D.) which is open at the bottom and extends to the surface where it is connected to other piping 16 which carries the sulfur to a suitable area. The open end of sulfur return pipe 15 is disposed near the bottom of the drill hole 10, i.e., at a vertical depth of about 1600 feet. A plate seal 17 is disposed within the liner 14 near its bottom and extends from the interior wall of the liner to the exterior wall of the sulfur return pipe 15, thus, sealing the upper portions from the lower portions of the liner. The lower portion of the liner is provided with a plurality of perforations 18 which permit molten sulfur to enter the liner and travel to and into the open bottom of sulfur return pipe 15. A portion of the liner above the plate seal 17 is provided with perforations 19 which permit hot water sent down the liner to exit from the liner and enter into the sulfur-bearing formation 11 adjacent the drill hole 10. A compressed air pipe 20 (about 0.75 inch diameter) extends into sulfur delivery pipe 15 for the purpose of introducing air into the molten sulfur rising therein, thereby providing lift to the molten sulfur to assist its ascension in pipe 15. As mining proceeds in the well shown in FIG. 2, a body 21 of warm to hot water accumulates in the upper strata of the formation in the areas of the barren limestone 22, the lower portions of the barren caprock 4 and in some cases the upper portions of the sulfur-bearing formation 11. In order to maintain the pressure within the formation at a suitable level to permit continued injection of water through the annular space between the liner 14 and the delivery pipe 15, cold water bleed wells 9 (see FIG. 1) bleed off water from those areas where it is expected to be the coolest, as diagrammatically illustrated in FIG. 1.

In the operation of the prior art systems shown in FIGS. 1 and 2, hot water having a temperature of 260° F. to 350° F. is produced in a power plant on the surface and supplied to the liner 14 through pipe 23. The hot water is forced down the sulfur well shown in FIG. 2 through the annular space existing between liner 14 and sulfur delivery pipe 15. The hot water exits through the liner wall through perforations 19 and comes into contact with the sulfur in the sulfur-bearing formation 11. After a heating up period which hot water is continually pumped down through the liner 14 and initially down through sulfur delivery pipe 15, the sulfur-bearing formation 11 begins to melt and forms a pool of molten sulfur at the bottom of liner 14. The flow of hot water through pipe 15 is discontinued. Subsequent volumes of hot water sent down through liner 14 and contacting the sulfur-bearing formation melt additional amounts of sulfur.

After contacting the sulfur-bearing ore, the hot water is somewhat cooled but still has a high enough temperature (e.g. 280° F.) relative to connate water to rise in the formation and become situated in the upper areas of the formation where it becomes trapped. The exact location of the trapped body of warm or hot water 21 is not precisely critical to the invention described or claimed herein. For example, it may or may not extend into the caprock strata 4 and it may or may not reside in the sulfur-bearing formation 11. The molten sulfur produced by the hot water enters the liner 14 through perforations 18 and eventually enters the open lower end of pipe 15 in which it rises due to the internal pressure in the formation caused by pumping down hot water through the liner 14 and control of said internal pressure through the bleeding off of bleedwater through the bleedwater well 9. The compressed air coming down through air supply pipe 20 (for example at a pressure of 440 psig) is injected into the molten sulfur in pipe 15 and reduces the specific gravity of the contents of pipe 15 causing said contents to rise and flow out through piping 16 to a suitable sulfur collecting reservoir (not shown). In a typical operation (after start-up) of the well shown in FIG. 2, an average of about 2 tons per hour of sulfur is produced using an average flow of hot water through liner 14 of 135 gallons per minute having an average temperature of 319° F. and an average pressure of 190 psig. This is equivalent to 3,838 gallons of the 190 psig water per ton of sulfur produced, and represents an input of energy of 8.43 million BTU per ton of sulfur produced.

The heat contained by the body of accumulated underground hot water 21 has not been utilized to any significant degree in prior sulfur wells utilizing the Frasch hot process and, in many cases, has been accumulating for many years. The body of accumulated underground hot water 21 has an average temperature of about 280° F. and constitutes a resource of heat which in some cases amounts to trillions of BTU's.

Figure 3:
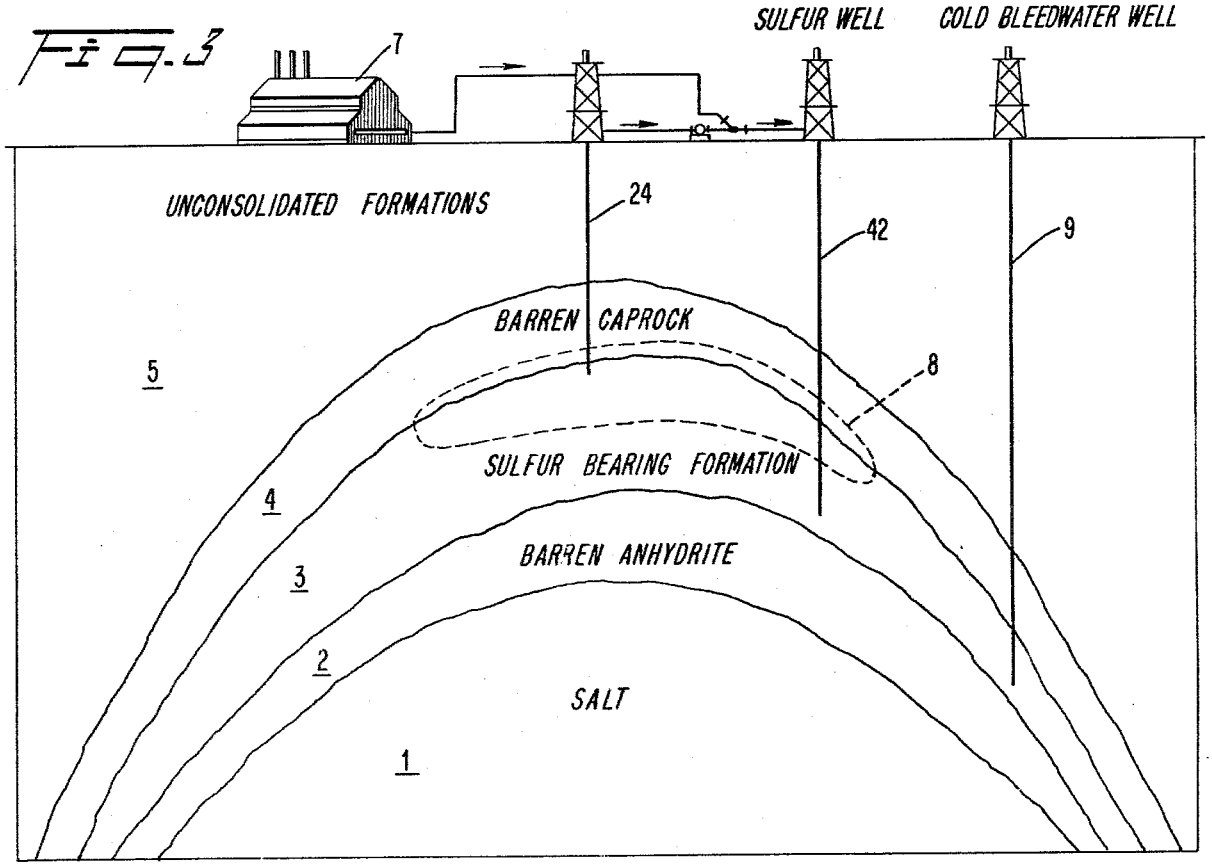
FIG. 3 is a diagrammatic vertical sectional view of a salt dome formation containing sulfur-bearing ore illustrating a system for mining sulfur according to the present invention.

The present invention utilizes and reclaims the heat stored in the body of accumulated underground hot water 21 of old wells and reduces the amount of hot water needed to sustain new wells. FIG. 3 broadly illustrates the system of the present invention. The underground formation, and the functions of cold bleedwater well 9 and plant 7 are the same as previously described and shown in FIG. 1. The invention adds hot bleedwater well 24 which withdraws the hot bleedwater accumulated in underground reservoir 8 and brings it to the surface. The hot bleedwater is normally at a temperature of between 220° F. and 320° F. After being brought to the surface, the hot bleedwater is mixed with fresh water at a temperature of between 325° F. and 450° F. produced by plant 7. The proportions of the mixture may vary, of course, due to the temperatures of the two constituents, but between 20% and 95% of the mixture, and preferably between 30 and 70%, may be hot bleedwater. The proportions should be adjusted so that the temperature of the mixture is no less than 260° F., preferably over 280° F. and most preferably between 320° F. and 330° F. This temperature ensures that the underground sulfur will be liquefied within a reasonable amount of time after the water is injected into the well.

Figure 5:
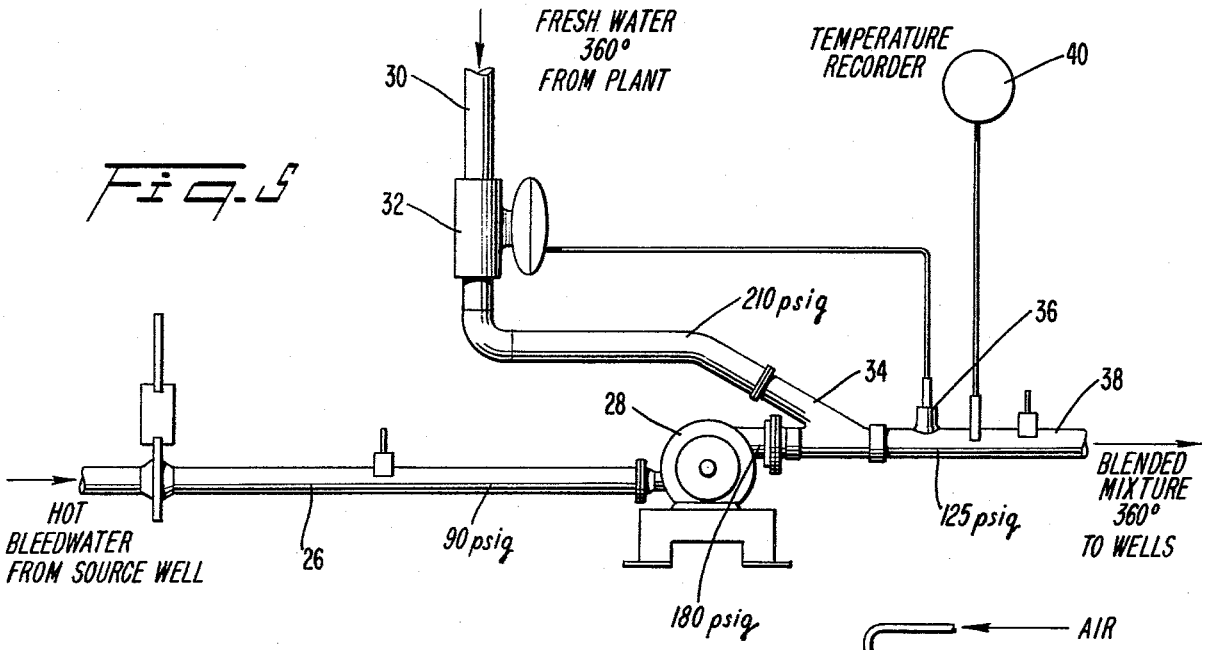
FIG. 5 is a detailed view of the mixing apparatus of the present invention.

The mixing apparatus is shown in detail in FIG. 5. Pipe 26 transports hot bleedwater from the outlet of well 24 (not shown) into pump 28. Pump 28 may be any type of pump, such as Dean-Hill Alloy 20 Pump or its equivalent. Obviously, any other type of pump may be substituted without exceeding the scope of the invention. Fresh hot water from plant 7 (see FIG. 3) is piped in via pipe 30, through temperature controlled valve 32 and into lateral 34. Lateral 34 is also connected to the output side of pump 28 so that the hot bleedwater is mixed with the fresh hot water. The pressure of the water in pipe 30 should be higher than the pressure of the water exiting pump 28 so as to avoid backflow through pipe 30. Illustrative pressures are shown in FIG. 5. Other pressures may be used, the only requirement being, of course, that the pressure of the blended mixture be lower than the pressure of the water in pipe 30 and than the pressure of the water exiting pump 28.

Temperature controlled valve 32 is operatively connected to temperature sensor 36 which senses the temperature of the water mixture in pipe 38 connected to the outlet of lateral 34. Valve 32 automatically adjusts the amount of hot, fresh water which is mixed with the bleedwater so as to maintain a relatively constant mixture temperature. Temperature recorder 40 may also be connected to pipe 38 so as to provide a permanent record of the mixture's temperature variations.

Figure 4:
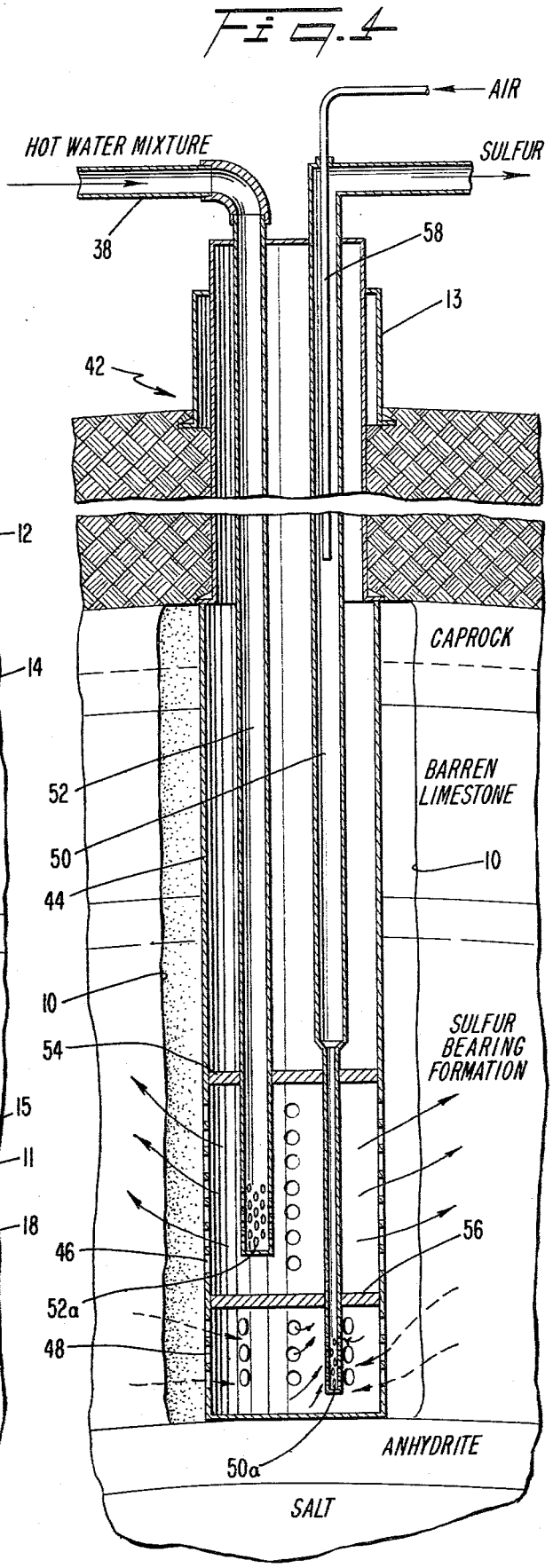
FIG. 4 is a vertical, sectional view of a sulfur well according to the present invention.

The sulfur well utilized by the system according to the invention is shown in FIG. 4. Well 42 is generally similar in dimensions to the prior art well previously described and insofar as it utilizes surface casing 13. Well liner 44 performs generally the same function as well liner 14 of the prior art, but is structurally different at its lower end. Liner 44 has two sets of perforations, 46 and 48, the purposes of which are to allow the hot water mixture to escape from well liner 44 and contact the sulfur, and to permit molten sulfur to enter into well liner 44, respectively. Instead of locating the sulfur pipe concentrically with the well casing and using the annular area surrounding the sulfur pipe for the hot water downflow as in the prior art well shown in FIG. 2, the instant well utilizes a sulfur return pipe 50 which is physically separate and distinct from hot water downpipe 52. Hot water downpipe 52 is connected to pipe 38 at its upper end such that the hot water (a mixture of hot bleedwater and fresh water) passes downwardly into the well in pipe 52. Downpipe 52 is perforated at its lowermost end portion, as at 52*a*. Sulfur return pipe 50 is also perforated at its lowermost portion as at 50*a*. Baffles 54 and 56 are placed across the well casing 44. Baffle 54 prevents the hot water from traveling back up into well casing 44 once it exits from downpipe 52, while baffle 56 prevents the hot water from entering sulfur return pipe 50.

In operation, the system functions as follows: hot, subterranean bleedwater 8 is drawn to the surface by hot bleedwater well 24 and mixed with fresh hot water from plant 7 by the mixing apparatus shown in FIG. 5 and previously described. The hot water mixture is transported to downpipe 52 via pipe 38 and passes downwardly into well 42. The hot water exits through perforations 52*a* and 46, and contacts the sulfur-bearing formation 11. Molten sulfur then passes through perforations 48 and 50*a*, and upwardly into sulfur return pipe 50. Air injected through air line 58 reduces the density of the molten sulfur, thereby enabling the sulfur to pass the rest of the way up sulfur return pipe 50, as in the standard Frasch hot process.

Figure 6:
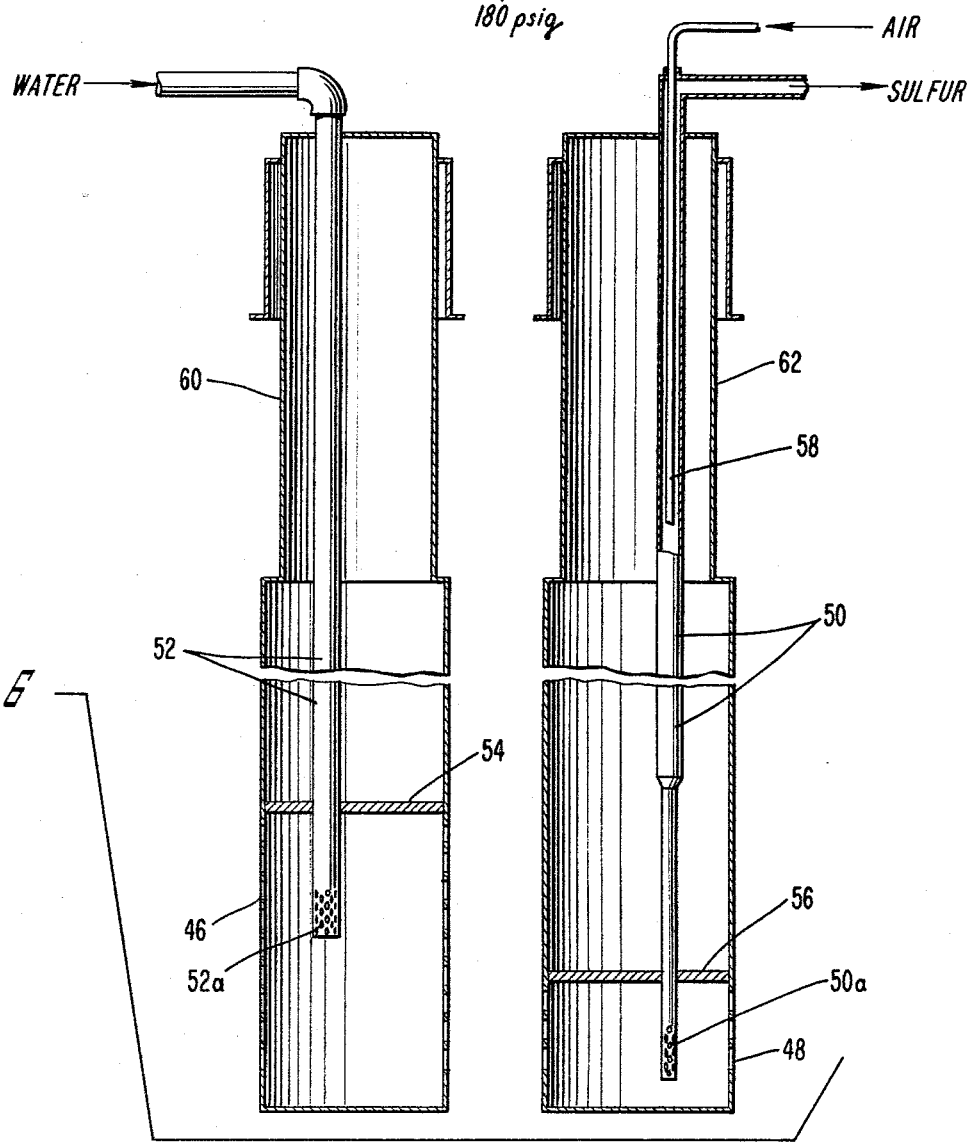
FIG. 6 is a vertical, sectional view of an alternative embodiment of a well casing according to the present invention.

In an alternative embodiment, the hot water downpipe 52 is located in its own, separate well casing 60 which is physically displaced from well casing 62, as shown in FIG. 6. Casing 62 contains only the sulfur return pipe 50 and air line 58 as shown. This embodiment operates in the same fashion as the previously described embodiment.

The sulfur bleedwater re-use system according to the invention enables the use of the highly corrosive and scaling subterranean bleedwater with minimal effects upon sulfur return piping. This is accomplished by physically separating the hot water downpipe from the sulfur return pipe so as to minimize the contact of the hot water with the sulfur pipe. Indeed, the invention may even lessen the amount of corrosion of the sulfur return pipe over the standard Frasch type process, since, in the instant invention, the only contact between the pipe and hot water occurs between baffles 54 and 56. In the system shown in FIG. 6, for example, there is practically no such contact. In the standard Frasch type well, shown in FIG. 2, the hot water is in contact with substantially the entire length of sulfur return pipe 15. The water in this process is, of course, of a much less corrosive nature than the bleedwater used in the invention, but it will eventually cause corrosion of the pipes with which it comes into contact.

Additional corrosion protection may be achieved by the addition of a corrosion inhibitor to the hot bleedwater, the fresh hot water, or to the mixture of the two. Any type of inhibitor may be used without exceeding the scope of the invention, but a quarternary amine, such as those marketed under the tradenames of Nalco Product No. 938, Visco 938 and Visco 1152 has been found to be effective.

The piping carrying the hot bleedwater and the bleedwater/fresh water mixture preferably has an inert, corrosion resistant lining, such as cement or phenolic. The lined piping, which is usually mild steel, may be combined with sections of stainless steel piping to give the system maximum corrosion protection while keeping the system costs down to a reasonable level. Any time two dissimilar metals come into contact in a high temperature, corrosive environment the possibility of galvanic corrosion exists. However, this potential problem can be avoided by using pipe couplings of the type disclosed in U.S. patent application Ser. No. 8,112 entitled "Dielectric Pipe Coupling for Use in High Temperature, Corrosive Environments" filed on Jan. 31, 1979. Obviously any other type of coupling which prevents galvanic corrosion may be utilized exceeding the scope of this invention.

The foregoing description should not be construed as limiting and various modifications thereof may be undertaken without exceeding the scope of the appended claims.

We claim:

1. In a method of mining an underground sulfur ore body in a subterranean deposit wherein hot water at a sufficiently high temperature to liquefy sulfur underground is contacted with said underground sulfur which is liquefied thereby and which is thereafter moved to the surface whereby said hot water is somewhat reduced in temperature and accumulates as a body of underground water above at least a part of said sulfur ore body, that improvement utilizing the heat of said accumulated, underground hot water, comprising:

(a) removing at least a portion of said accumulated underground hot water from its subterranean location and bringing it above the ground surface;

(b) mixing said removed hot water with fresh hot water having a higher temperature than said removed water; and (c) returning said mixed hot water to said underground sulfur ore body, so as to further liquefy said sulfur, through a hot water downpipe physically separated from a sulfur return pipe through which the molten sulfur is withdrawn from said subterranean deposit such that the outer surface of said sulfur return pipe is not contacted by said mixed hot water along at least a substantial portion of the length of said sulfur return pipe.

2. The improved method of claim 1 wherein said hot water downpipe and said sulfur return pipe share a common well casing.

3. The improved method of claim 1 wherein a well casing through which said hot water downpipe passes is separate and distinct from a well casing containing the sulfur return pipe.

4. The improved method of claim 1 wherein the temperature of the accumulated water brought to the surface is between 220° F. and 320° F.

5. The improved method of claims 1 or 4 wherein the temperature of the fresh hot water is between 325° F. and 450° F.

6. The improved method of claim 1 wherein the temperature of the mixed hot water is greater than 260° F.

7. The improved method of claim 1 wherein the temperature of the mixed hot water is greater than 280° F.

8. The improved method of claim 1 wherein the temperature of the mixed hot water is between 320° F. and 330° F.

9. The improved method of claim 1 wherein the volume of fresh hot water in the mixture is between 5% and 80%.

10. The improved method of claim 1 wherein the volume of fresh hot water in the mixture is approximately 60%.

11. The improved method of claim 1 wherein said accumulated underground hot water is brought to the surface through a well pipeline physically separated from said sulfur return pipe and said hot water downpipe.

12. In an apparatus for mining a subterranean sulfur-bearing ore body by liquefying the sulfur, including return piping means for bringing the molten sulfur to the surface, wherein a zone of underground hot water accumulates above at least a portion of said sulfur-bearing ore body, the improvements comprising:

(a) first well means for bringing at least a portion of said underground accumulated hot water to the surface;

(b) mixing means to mix the portion of said accumulated hot water brought to the surface with fresh water having a higher temperature than said accumulated hot water; and (c) second well means having a hot water downpipe to direct the mixed hot water down into the sulfur-bearing ore body to further liquefy the sulfur, said hot water downpipe being physically separated from said sulfur piping means such that the outer surface of said sulfur return pipe is not contacted by said mixed hot water along at least a substantial portion of the length of said sulfur return pipe.

13. The improved apparatus of claim 12 wherein piping carrying said accumulated hot water and said mixed hot water has an inert lining to prevent corrosion or scaling.

14. The improved apparatus of claim 12 wherein said second well means also contains said sulfur return piping means.

15. The improved apparatus of claim 14 wherein said second well means comprises:

(a) a well casing extending from the surface down into the sulfur-bearing ore body, said casing having upper and lower sets of perforations near its lower extremity;

(b) hot water downpipe means extending within said well casing from the surface down to a position adjacent said upper set of perforations such that hot mixed water passing downwardly through said downpipe will pass outwardly through said upper perforations and melt the sulfur;

(c) sulfur return pipe means extending within said well casing from the surface down to a position adjacent the lower set of perforations so as to enable molten sulfur, after passing through said lower perforations, to pass upwardly into said sulfur return pipe; and (d) means in said well casing to prevent fluid communication between said upper and lower sets of perforations within said well casing.

16. The improved apparatus of claim 15 wherein said means to prevent fluid communication within said well casing comprises a baffle affixed across the well casing between said upper and lower sets of perforations, said baffle having means to allow said sulfur return pipe to extend therethrough.

17. The improved apparatus of claim 16 further comprising a second baffle affixed across the well casing above the upper set of perforations to prevent hot mixed water from traveling upwardly through the well casing.

* * * * *